US006923122B2

(12) United States Patent
Hennings et al.

(10) Patent No.: US 6,923,122 B2
(45) Date of Patent: Aug. 2, 2005

(54) ENERGETIC MATERIAL INITIATION DEVICE UTILIZING EXPLODING FOIL INITIATED IGNITION SYSTEM WITH SECONDARY EXPLOSIVE MATERIAL

(75) Inventors: George N. Hennings, Ridgecrest, CA (US); Dieter K. Teschke, Vacaville, CA (US); Richard K. Reynolds, Calistoga, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 10/316,126

(22) Filed: Dec. 10, 2002

(65) Prior Publication Data

US 2004/0107856 A1 Jun. 10, 2004

(51) Int. Cl.[7] ..... F42C 11/00
(52) U.S. Cl. ..... 102/202.7; 102/204
(58) Field of Search ..... 102/202.7, 202.6, 102/202.5, 204, 530, 202.2; 280/737; F42C 19/04, 11/00; F42B 3/00

(56) References Cited

U.S. PATENT DOCUMENTS 1,313,801 A * 8/1919 Doran ..... 102/204
4,144,814 A * 3/1979 Day et al. ..... 102/202.13
4,541,342 A * 9/1985 Routledge ..... 102/308
4,735,145 A * 4/1988 Johnson et al. ..... 102/202.5
5,030,301 A * 7/1991 Stout et al. ..... 149/5
5,113,764 A * 5/1992 Mandigo et al. ..... 102/202.9
5,411,290 A * 5/1995 Chan et al. ..... 280/737
5,721,392 A * 2/1998 Chan et al. ..... 102/275.1
6,568,331 B2 * 5/2003 Hofmann et al. ..... 102/464
2003/0200890 A1 * 10/2003 Reynolds et al. ..... 102/202.5

OTHER PUBLICATIONS

U.S. Appl. No.: 10/137,063, Filed: Apr. 30, 2002, Inventor: Thomas M. Nickolin et al.

* cited by examiner

*Primary Examiner*—Michael J. Carone
*Assistant Examiner*—Susan C. Alimenti
(74) *Attorney, Agent, or Firm*—Harness, Dickey & Pierce, P.L.C.

(57) ABSTRACT

A device and method that employs a detonation event as an energy source for producing a pyrotechnic output. The device includes an initiation charge that is selectively detonated by an exploding foil initiator. Byproducts from the detonation event are attenuated by a barrier that is disposed between the initiation charge and an ignition charge. The barrier participates in a chemical reaction with the detonation byproducts to oxidize and burn. In this regard, the barrier serves as a fuel that is employed to ignite the ignition charge. The device includes a sealed housing in which the initiator, initiation charge and ignition charges are housed. The housing ruptures in response to the heat and pressure generated by the ignited ignition charge to release the pyrotechnic output.

44 Claims, 13 Drawing Sheets

ENERGETIC MATERIAL INITIATION DEVICE UTILIZING EXPLODING FOIL INITIATED IGNITION SYSTEM WITH SECONDARY EXPLOSIVE MATERIAL

FIELD OF THE INVENTION

The present invention generally relates to energetic material initiation devices and more particularly to an energetic material initiation device that converts a detonation shockwave to a deflagration output having a high pressure, high temperature impulse.

BACKGROUND OF THE INVENTION

Currently, exploding foil initiators (EFI's) represent the "state of the art" with regard to devices for initiating detonation in an explosive charge through a relatively high-energy pulse or shockwave as exploding foil initiators are insensitive to induced or radiated electrical energy, such as electromagnetic interference (EMI) or low energy pulses, and utilize a secondary explosive, which are relatively impervious to impacts and high temperatures, for producing the high-energy pulse. The ability to withstand impacts as well as electrical, electromagnetic and thermal energy renders exploding foil initiators relatively safe and thus very desirable for a significant number of detonation applications. Consequently, exploding foil initiators are widely used in military applications, such as warhead fuzes as detailed in Military Standard Mil-Std-1316: Safety Criteria for Fuze Design. This standard provides guidance for initiation technologies that can be used in-line with a warhead main charge explosive train. The unique characteristics of an EFI allow it to meet the requirements for in-line useage without any interrupter or alignment mechanism. The safety of the design is shifted in large part to the electronic circuits that arm the firing circuit that initiates the EFI. This unique capability enables the EFI to be remotely located from the safety circuit, which further enables designs that can fire sequentially or with a high degree of simultaneity. These distributed designs require only one set of safe and arming circuits, minimizing the weight, volume and cost of the design.

Despite their success and relative safety in applications where detonation is desired, exploding foil initiators have not been widely used in pyrotechnic applications where deflagration rather than detonation is desired. One drawback with the use of exploding foil initiators in pyrotechnic applications concerns the strength of the shockwave that is typically produced; the shockwave produced is ordinarily so strong as to actually damage or detonate the pyrotechnic material, rather than to initiate its burning as desired for proper operation. Consequently, a bulkhead between the EFI and the pyrotechnic device is commonly employed to attenuate the shockwave and limit the amount of energy that is transmitted to the pyrotechnic material.

The use of the bulkhead of the pyrotechnic ignition system, however, is undesirable because of the added weight and volume. A further concern includes the need for expensive machining of the bulkhead to ensure accurate attenuation of the shockwave since the pyrotechnic material would fail to ignite if the shockwave were to be too severely attenuated. Conversely, if the shockwave is not sufficiently attenuated, there is a risk of damaging the pyrotechnic system and having a safety or reliability failure. The variation in the output of the initiator and effects of temperature on the materials further compound this problem and require costly quality controls to ensure the safety and reliability of the system. This requires qualification and acceptance testing of the assembly with system hardware and critical inspections of the bulkhead interface.

In view of the above noted drawbacks, low energy initiation systems are most commonly employed to initiate a deflagration event in a pyrotechnic material. Such low energy initiation systems typically include a bridge or hot wire that must be in very close proximity to a pyrotechnic initiation material. The close proximity of the bridge or hot wire to the pyrotechnic ignition material, however, increases the potential, relative to initiation systems that utilize exploding foil initiators, for inadvertent or accidental initiation as a result of EMI or lightning, for example. These hot wire devices are therefore required to be kept out of alignment with the pyrotechnic train and need to be moved into alignment prior to firing. This is accomplished by the use of electromechanical devices to translate or rotate the initiator and the pyrotechnic acceptor into alignment. These devices are inherently expensive, bulky and add significant weight. Further the device must be located next to the pyrotechnic compound being ignited provide adequate safety, reducing the design options and increasing design complexity.

In view of the aforementioned drawbacks associated with exploding foil initiators and low energy initiation systems, there remains a need in the art for an improved initiation device for initiating a deflagration event in a pyrotechnic material in a very reliable and safe manner.

SUMMARY OF THE INVENTION

In one preferred form, the present invention provides an energetic material initiation device that includes an initiation charge, an exploding foil initiator, an ignition charge and a barrier structure. The exploding foil initiator is selectively actuatable for detonating the initiation charge. The barrier structure is disposed between the initiation charge and the ignition charge and combusts in response to energy released during detonation of the initiation charge to initiate combustion in the ignition charge and thereby produce a pyrotechnic output.

In another preferred form, the present invention provides a method for forming a pyrotechnic output. The method includes the steps of: impacting a first charge to detonate the first charge; attenuating a shockwave produced by the detonating first charge with a barrier, the barrier also serving as a fuel that is oxidized by byproducts of the detonating first charge; and igniting a second charge with the oxidizing fuel.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
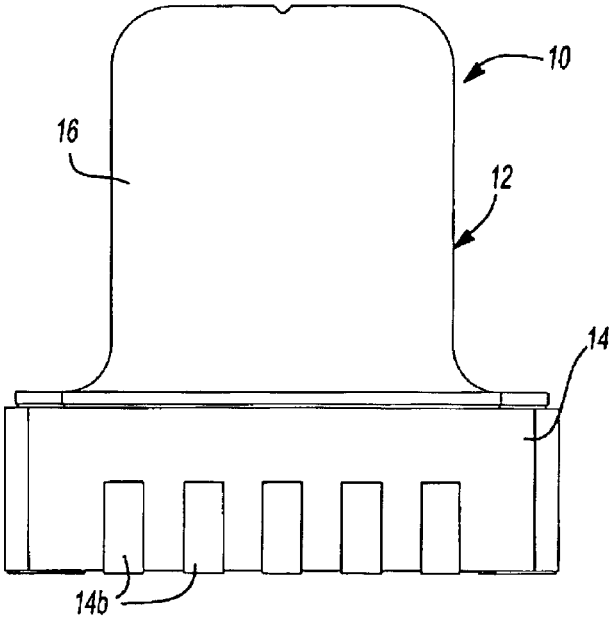
FIG. 1 is a side elevation view of an energetic material initiation device constructed in accordance with the teachings of the present invention.
Figure 3:
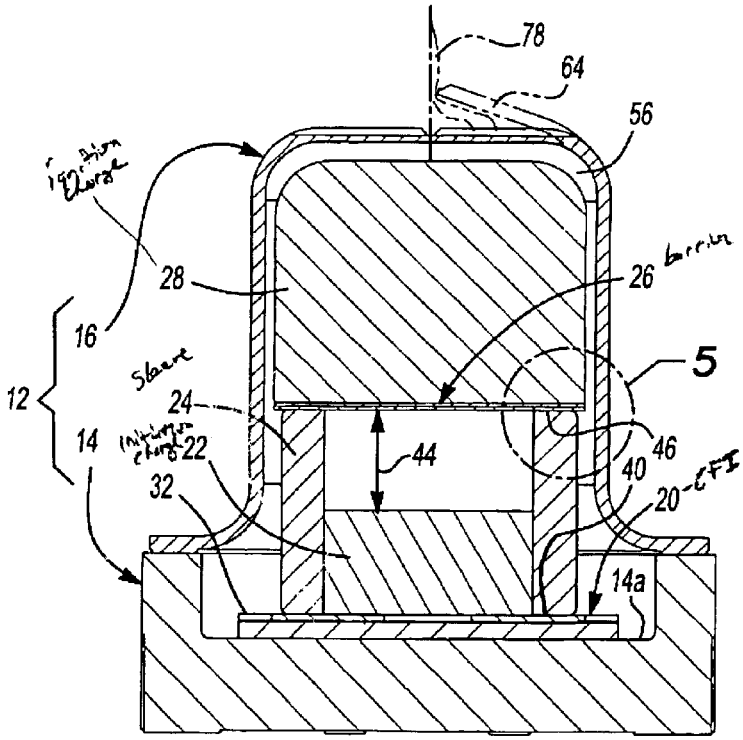
FIG. 3 is a longitudinal section view of the energetic material initiation device of FIG. 1.
Figure 2:
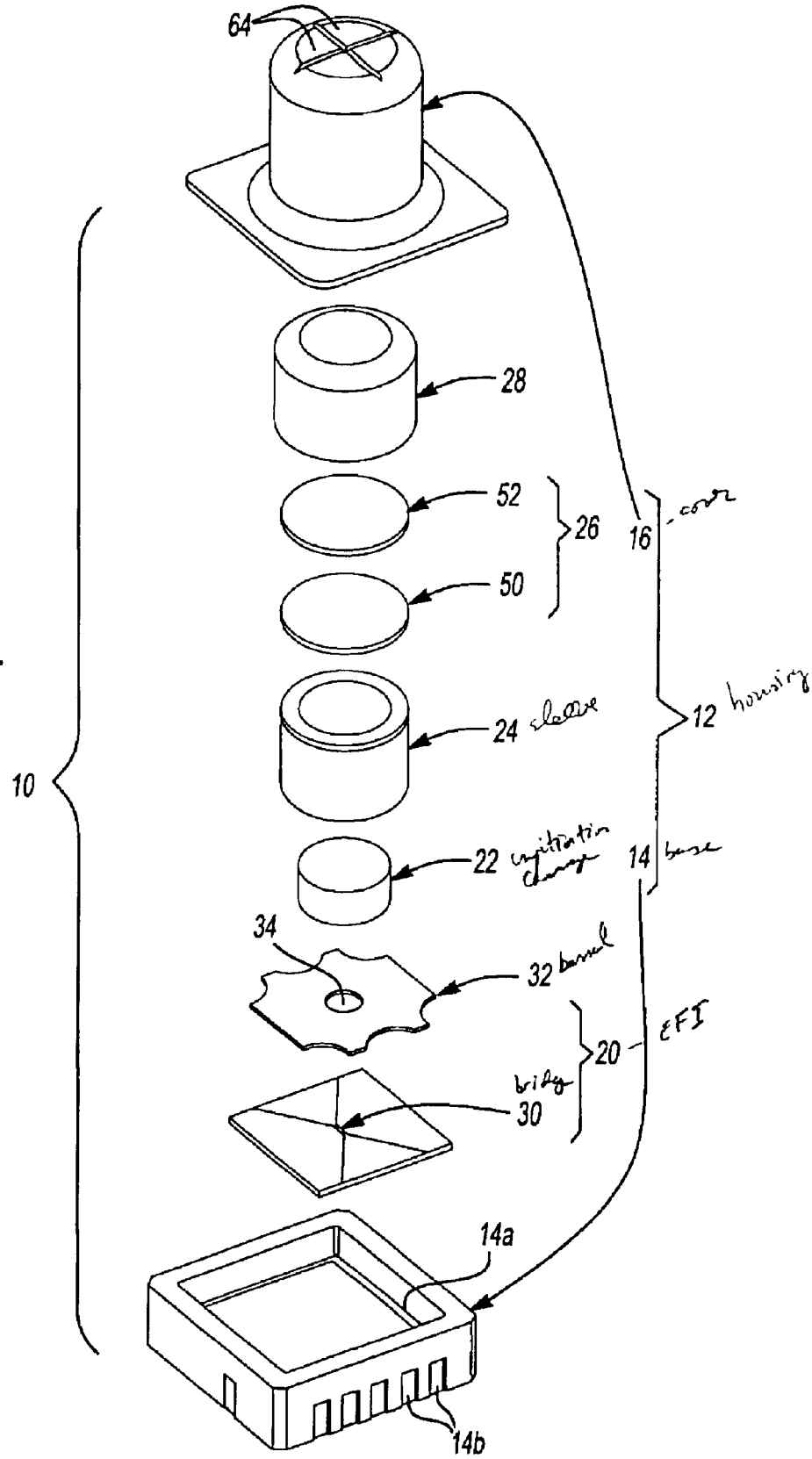
FIG. 2 is an exploded perspective view of the energetic material initiation device of FIG. 1.

With reference to FIGS. 1 through 3 of the drawings, an energetic material initiation device constructed in accordance with the teachings of the present invention is generally indicated by reference numeral 10. The energetic material initiation device 10 is illustrated to include a housing 12, which in the particular example provided, includes a base 14 and a cover 16. As best seen in FIGS. 2 and 3, an exploding foil initiator 20, an initiation charge 22, a sleeve 24, a barrier structure 26 and an ignition charge 28 are disposed within the housing 12.

The exploding foil initiator 20 is conventional in its construction and operation and as such, will not be described in exhaustive detail herein. Briefly, the exploding foil initiator 20 includes a bridge 30, a flyer (not specifically shown) and a barrel 32. When the energetic material initiation device 10 is to be actuated, a high current pulse, typically in excess of 1000 amps, is passed through the bridge 30, causing the bridge 30 to vaporize and form conductive plasma. The hot, high pressure plasma propels the flyer through a hole 34 in the barrel 32 toward the initiation charge 22 at a very high velocity. Additional details and background on exploding foil initiators, as well as the use of an integrated planar switches in exploding foil initiators are detailed in co-pending U.S. patent application Ser. No. 10/137,063 filed Apr. 30, 2002 entitled "Integrated Planar Switch for a Munition", the disclosure of which is hereby incorporated by reference as if fully set forth herein.

Figure 4:
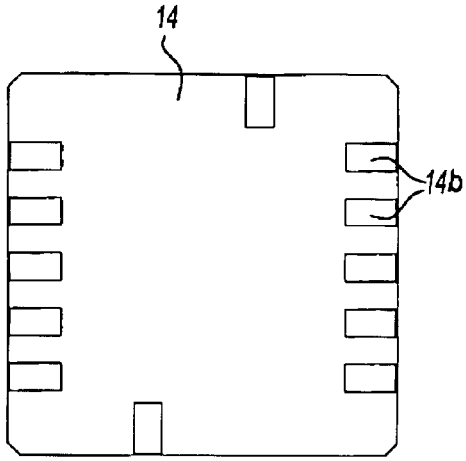
FIG. 4 is a bottom view of a portion of the energetic material initiation device of FIG. 1, illustrating the base in greater detail.

In the particular example provided, the base 14 includes a ceramic, leadless chip carrier 14*a* to which the exploding foil initiator 20 is fixedly coupled. The base 14 acts as a backing layer to all of the functioning elements of the energetic material initiation device 10 and serves as the recoil damper which directs all of the shock energy in a direction toward the cover 16. With brief additional reference to FIG. 4, the chip carrier 14*a* includes a plurality of electric terminals 14*b* that are configured to be coupled to a suitable energy source, such as a capacitor (not shown). The electric terminals 14*b* are also configured to be electrically coupled to the bridge 30 of the exploding foil initiator 20.

Returning to FIGS. 2 and 3, the sleeve 24 defines a hollow cavity into which the initiation charge 22 is disposed. The sleeve 24 includes a first end 40, which may be abutted against the exploding foil initiator 20 and/or the base 14. The initiation charge 22 is placed within the sleeve 24 in a desired proximity relative to the flyer of the exploding foil initiator 20 so that the flyer is able to impact the initiation charge 22 with sufficient energy. In the particular example provided, the initiation charge 22 is positioned within the sleeve 24 so as to abut the distal surface of the barrel 32. The sleeve 24 is formed from a suitable material, such as anodized aluminum or another suitable insulator, which permits the material that forms the initiation charge 22 to be compressed therein to a desired density. In the particular embodiment illustrated, the initiation charge 22 is compressed within the sleeve 24 so as to form a gap 44 between the distal end of the initiation charge 22 and the second, distal end 46 of the sleeve 24.

In the particular example provided, the material that forms the initiation charge 22 is RSI-007, which is available from Reynolds Systems, Inc. of Middletown, Calif. The RSI-007 material is described in detail in co-pending U.S. patent application Ser. No. 10/002,894 filed Dec. 5, 2001 entitled "Low Energy Initiated Explosive" (U.S. Patent Application Publication 20020079030), the disclosure of which is hereby incorporated by reference. Those skilled in the art will appreciate, however, that the initiation charge 22 may be made of any material that may be detonated by an exploding foil initiator, including explosives such as HNS-IV, HNS-I, PETN, NONA and CL-20 FPS.

In the example provided, the barrier structure 26 is abutted against the second end 46 of the sleeve 24 and operatively separates the initiation charge 22 and the ignition charge 28. The barrier structure 26 attenuates the shockwave that is generated by the detonation of the initiation charge 22 (via the flyer of the exploding foil initiator 20), provides a material which burns in response to the high heat and pressure of the detonating initiation charge 22 to thereby ignite the ignition charge 28 and preferably inhibits oxidizers, such as air, from entering in or exiting the gap 44.

In the example illustrated, the barrier structure 26 is a composite that includes a reactable member 50, which may be formed from a metal such as titanium or another suitably reactive material that is inert under normal circumstances, and an oxidizer barrier member 52, which is formed from a material such as Teflon® (i.e., polytetrafluoroethylene). Alternatively, the barrier structure 26 may also include an appropriate filler material, such as Teflon® (i.e., polytetrafluoroethylene) powder, that is used to fill the gap 44.

The ignition charge 28 is formed from a suitable material that may be used for initiating ignition or deflagration in a pyrotechnic material. In the example provided, the ignition charge 28 is formed from boron potassium nitrate ($BKNO_3$) which is loosely packed within the cavity 56 defined by the cover 16. As those skilled in the art will appreciate, the ignition charge 28 may alternatively be of a pellet or granule form, or any combination of powder, pellets and/or granules. The oxidizer barrier member 52 is employed to secure the ignition charge 28 to the cover 16 during the assembly of the energetic material initiation device 10. The cover 16 is preferably sealingly secured to the base 14 through an appropriate means, such as welding.

Figure 6:
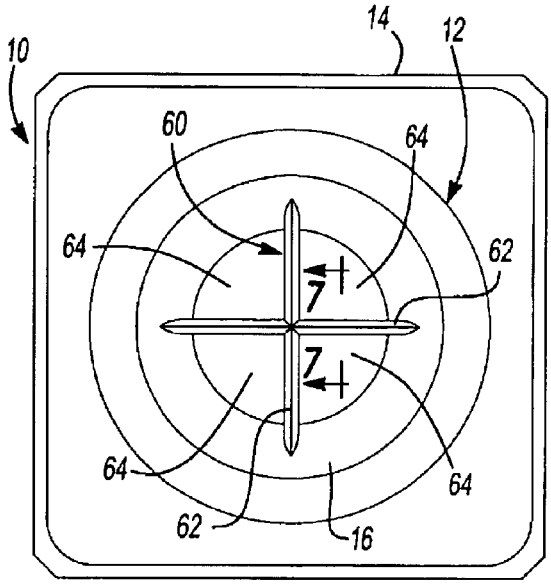
FIG. 6 is a top plan view of the energetic material initiation device of FIG. 1.
Figure 7:
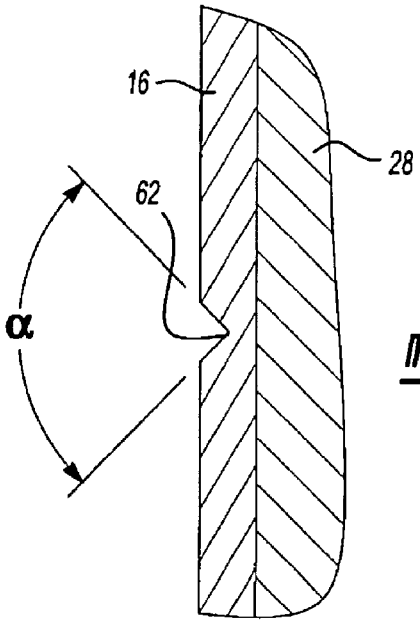
FIG. 7 is a partial sectional view of the energetic material initiation device taken along the line 7—7 of FIG. 6.

With reference to FIGS. 6 and 7, the cover 16 is illustrated to include one or more stress risers 60 that render one or more areas of the cover 16 more susceptible to rupturing upon ignition of the ignition charge 28. In the example provided, the stress riser 60 is formed by a plurality of intersecting features 62, such as grooves, that cooperate to define four petals or folds 64 which deploy outwardly when the cover 16 ruptures. The grooves that constitute the intersecting features 62 in this example are illustrated to be defined by an included angle $\alpha$ of about 90°. Those skilled in the art will appreciate that other values of the included angle $\alpha$ may be used in the alternative.

Figure 8:
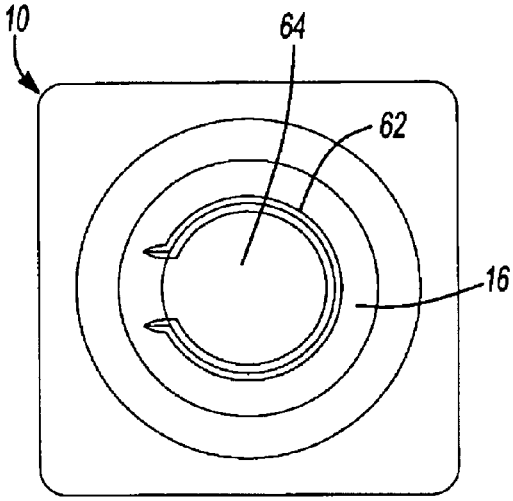
FIGS. 8 and 9 are views similar to that of FIG. 6 but which illustrate alternately configured stress risers.
Figure 9:
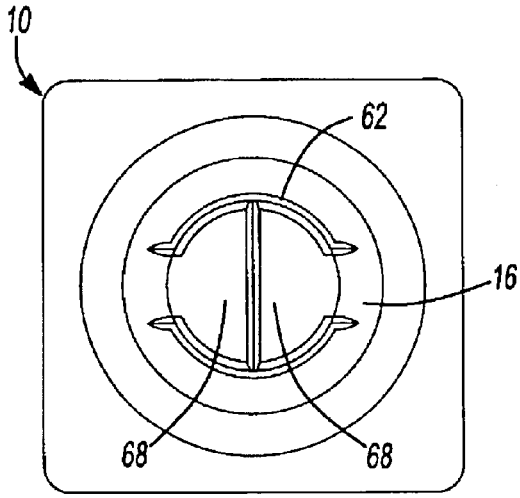

As those skilled in the art will appreciate the stress riser(s) 60 may be formed in any appropriate manner and/or configuration and as such, the embodiment provided herein is merely exemplary. As those skilled in the art will appreciate, other features 62, such as perforations (i.e., spaced-apart grooves, rather than continuous grooves) or areas of reduced thickness may be employed to form the stress riser(s) 60. Furthermore, those skilled in the art will appreciate that the configuration of the stress riser(s) 60 need not provide folds, but rather could form any predefined shape. For example, the stress riser 60 could be configured with a single hinged tab 64 as illustrated in FIG. 8 or a pair of hinged tabs 68 as illustrated in FIG. 9. Alternatively, the stress riser(s) 60 may be configured to form a shape that is not predetermined (i.e., randomly rupture in a predetermined area), as when the area of the rupture is machined or formed relatively thinner than the surrounding area of the cover 16 so that the area of the rupture is predetermined but the shape of the rupture is not.

Figure 10:
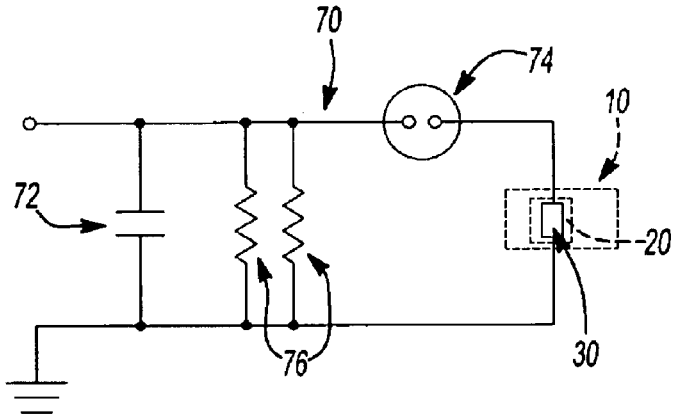
FIG. 10 is a schematic view illustrating a "charge-and-fire" firing circuit for activating the energetic material initiation device of FIG. 1.

In FIG. 10, an exemplary firing circuit 70 is illustrated for use in activating the energetic material initiation device 10. The firing circuit 70 is illustrated to be of the "charge-and-fire" type, having a high voltage capacitor 72 with a capacitance greater than about 0.1 microfarad and which is charged to a sufficient voltage (e.g., greater than about 1000 volts), a high-energy over-voltage switch 74 and one or more appropriately sized bleed resistors 76. Those skilled in the art will appreciate that a built-in planar over-voltage switch of the type disclosed in copending U.S. patent application Ser. No. 10/137,063 may be employed as the over-voltage switch 74.

When activation of the energetic material initiation device 10 is desired, the voltage on the capacitor 72 is increased to or beyond the breakdown voltage of the over-voltage switch 74 so that the energy stored in the capacitor 72 is released and discharged across the bridge 30 of the exploding foil initiator 20 as described above. As noted above, the plasma created by the vaporization of the bridge 30 generates heat and pressure which causes the flyer to be expelled through the barrel 32 (FIG. 2) and into contact with the initiation charge 22 (FIG. 2) such that the initiation charge 22 detonates.

Figure 5:
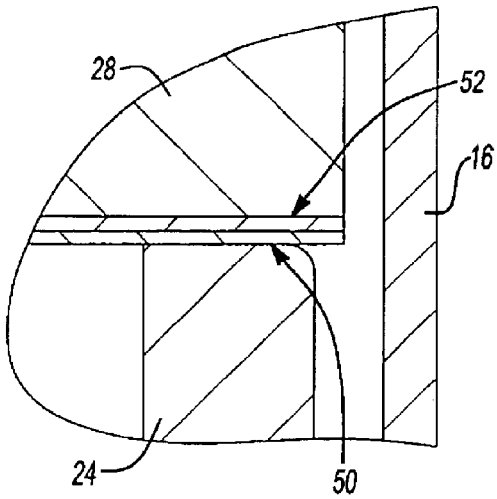
FIG. 5 is an enlarged portion of FIG. 3.

With renewed reference to FIGS. 2, 3 and 5, detonation of the initiation charge 22 generates heat and pressure which cooperate with the hot, energetic particles produced during detonation to ignite and/or burn the barrier structure 26. Stated another way, at least a portion of the barrier structure 26 participates in a chemical reaction with the byproducts of the detonating initiation charge 22, causing the barrier structure 26, in whole or in part, to oxidize and burn. In this regard, the barrier structure 26 serves as a fuel that is employed to ignite the ignition charge 28. Accordingly, in the example provided, the reactable member 50 ignites and produces intense heat, which burns through the oxidizer barrier member 52 and ignites the ignition charge 28.

Ignition of the ignition charge 28 generates heat and pressure within the confined space of the housing 12. As the heat and pressure increase, they cooperate to rupture the cover 16 in the area of the stress riser 60, producing an output kernel or pyrotechnic output 78 which is capable of igniting an adjacent pyrotechnic material (not shown), such as the fuel of a rocket motor (not shown).

Alternatively, the energetic material initiation device 10 may be activated to for the gaseous byproduct of the pyrotechnic output 78. In this regard, combustion of the ignition charge 28 releases a relatively large amount of gas. Accordingly, the energetic material initiation device 10 of the present invention may be employed as a gas generator to provide energy (in the form of a gas under pressure) that may be employed to move various actuators, valves, pin pullers, ejectors and piston driven devices.

Figure 11:
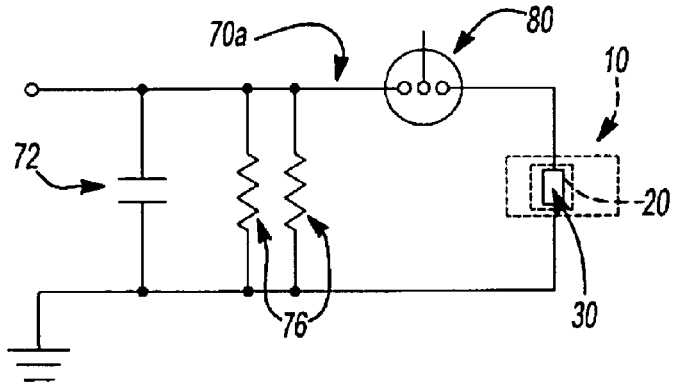
FIG. 11 is a schematic view illustrating a "triggered" firing circuit for activating the energetic material initiation device of FIG. 1.

With reference to FIG. 11, another exemplary firing circuit **70*a* is illustrated for use in activating the energetic material initiation device 10. The firing circuit 70*a* is generally similar to the firing circuit 70, except that a trigger switch 80, rather than an over-voltage switch, is employed. The firing circuit 70*a* allows the circuit to be charged and ready to fire upon receipt of a fire pulse that is delivered through the trigger switch 80. As those skilled in the art will appreciate, the firing circuit 70*a* may be used where precise timing of the actuation of the energetic material initiation device is required. Those skilled in the art will also appreciate that a built-in planar triggered switch of the type disclosed in copending U.S. patent application Ser. No. 10/137,063 may be employed as the trigger switch 80**.

Figure 12:
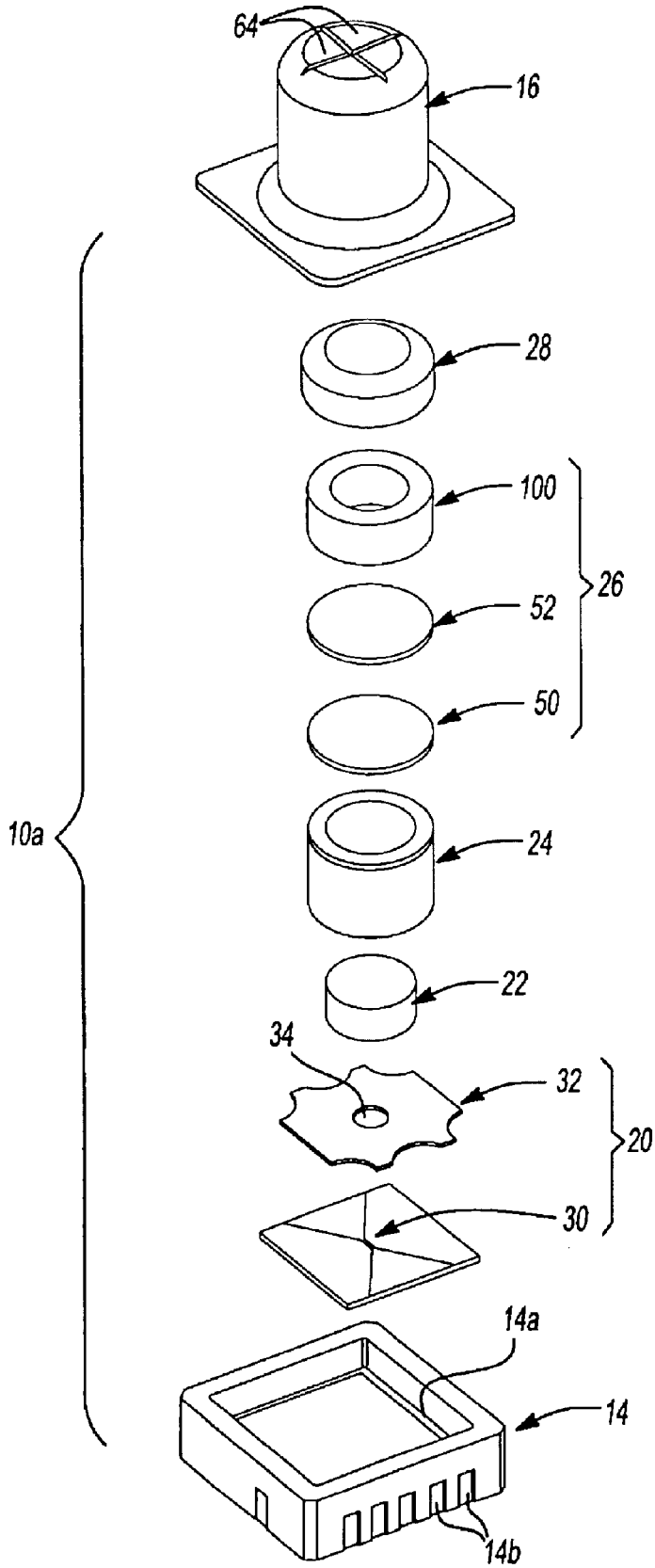
FIG. 12 is an exploded perspective view of a second energetic material initiation device constructed in accordance with the teachings of the present invention.
Figure 13:
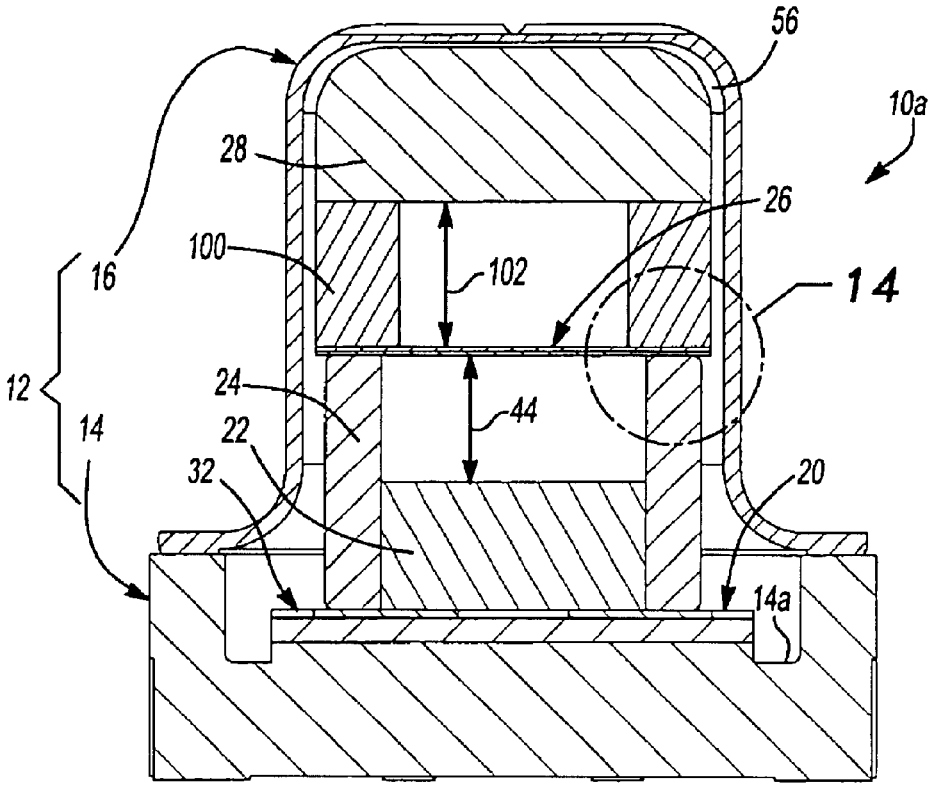
FIG. 13 is a longitudinal section view of the energetic material initiation device of FIG. 12.
Figure 14:
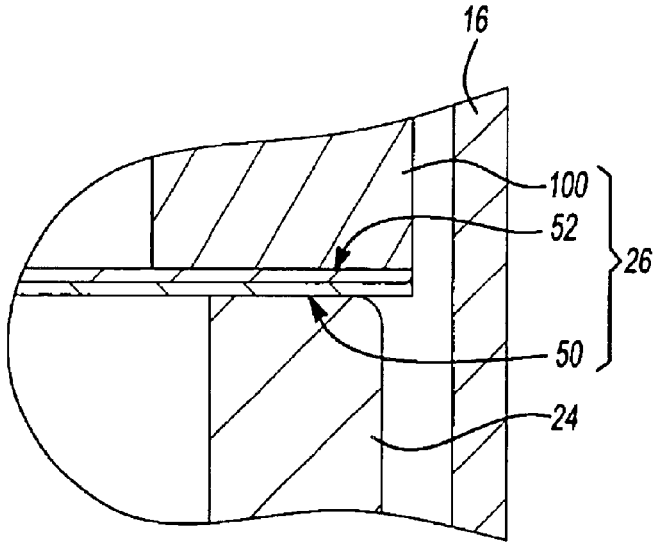
FIG. 14 is an enlarged portion of FIG. 13.

In FIGS. 12 through 14, a second energetic material initiation device constructed in accordance with the teachings of the present invention is generally indicated by reference numeral **10*a*. The material initiation device 10*a* is generally identical to the material initiation device 10 of FIG. 1, except that the barrier structure includes a hollow compliant member 100 that is disposed between the oxidizer barrier member 52 and the ignition charge 28 to attenuate the pyrotechnic output. In the particular embodiment illustrated, the hollow compliant member 100 is formed from rubber or another suitable elastomer. The hollow compliant member 100 also serves to space the ignition charge 28 apart from the oxidizer barrier member 52 by a secondary gap distance 102. In the example provided, the ignition charge 28 is compacted into a pellet so that the pyrotechnic material from which it is made does not contact the oxidizer barrier member 52. Alternatively, an appropriately constructed secondary barrier (not shown) may be placed between the ignition charge 28 and the hollow compliant member 100 if the ignition charge 28 were to be loosely packed within the cavity 56 that is defined by the cover 16**.

Figure 15:
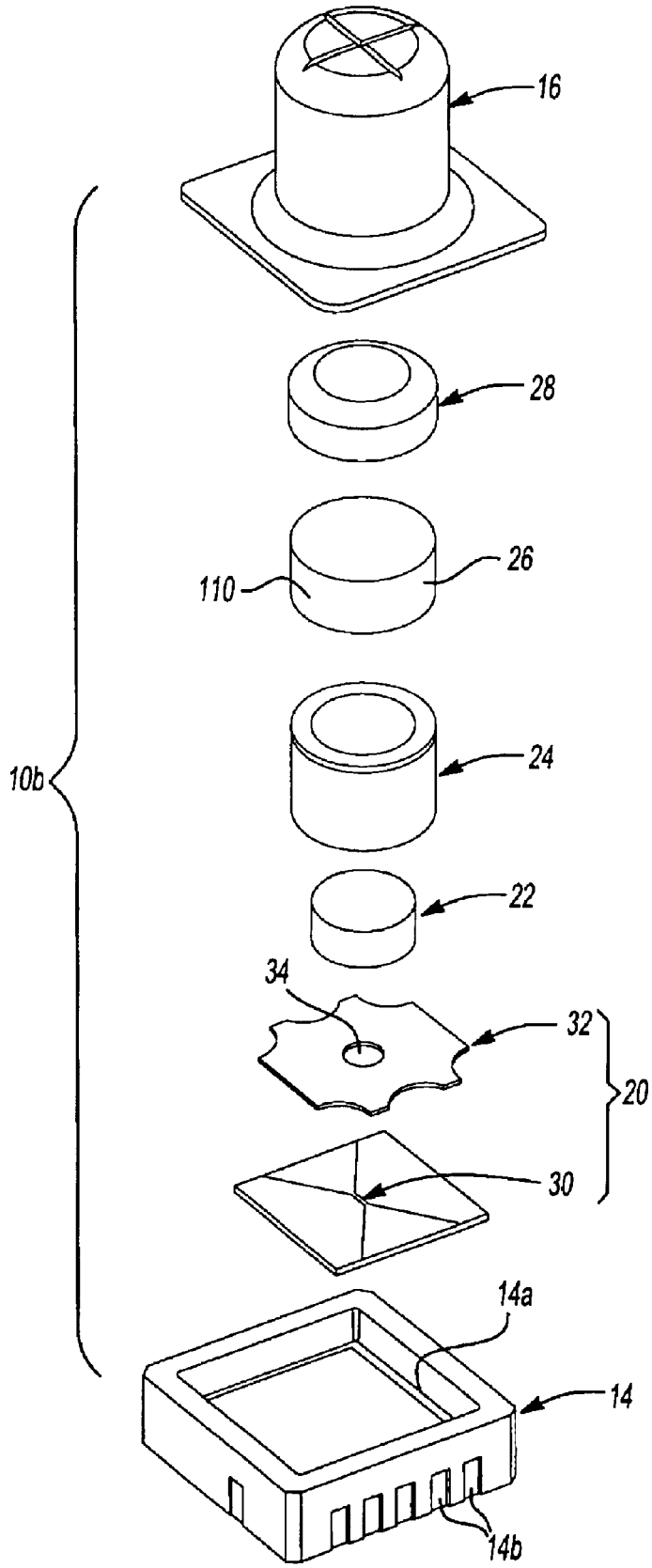
FIG. 15 is an exploded perspective view of a third energetic material initiation device constructed in accordance with the teachings of the present invention.
Figure 16:
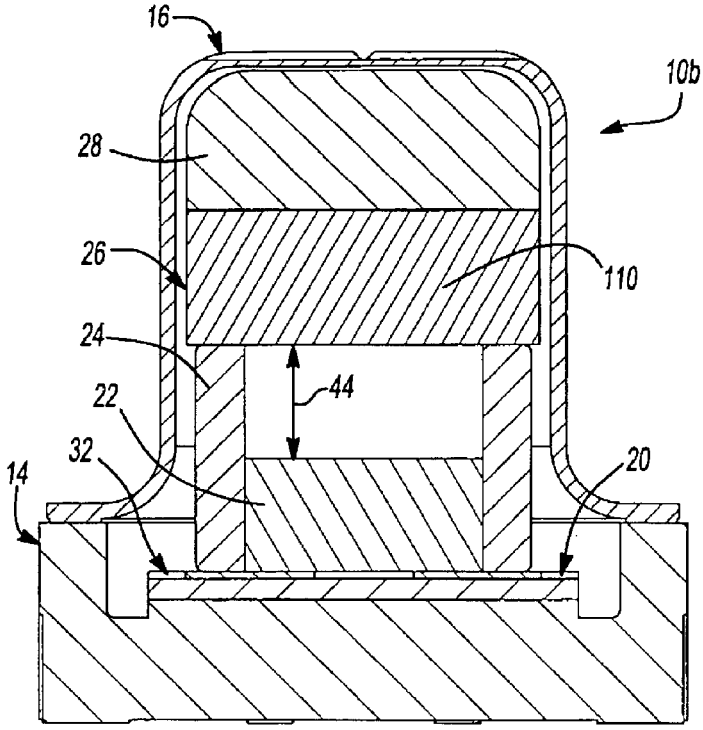
FIG. 16 is a longitudinal section view of the energetic material initiation device of FIG. 15.

In FIGS. 15 and 16, a third energetic material initiation device constructed in accordance with the teachings of the present invention is generally indicated by reference numeral 10*b*. The material initiation device 10*b* is generally similar to the material initiation device 10 of FIG. 1, except that the barrier structure 26 is comprised of a solid compliant member 110. In the particular embodiment illustrated, the solid compliant member 110 is formed from rubber or another suitable elastomer.

Figure 18:
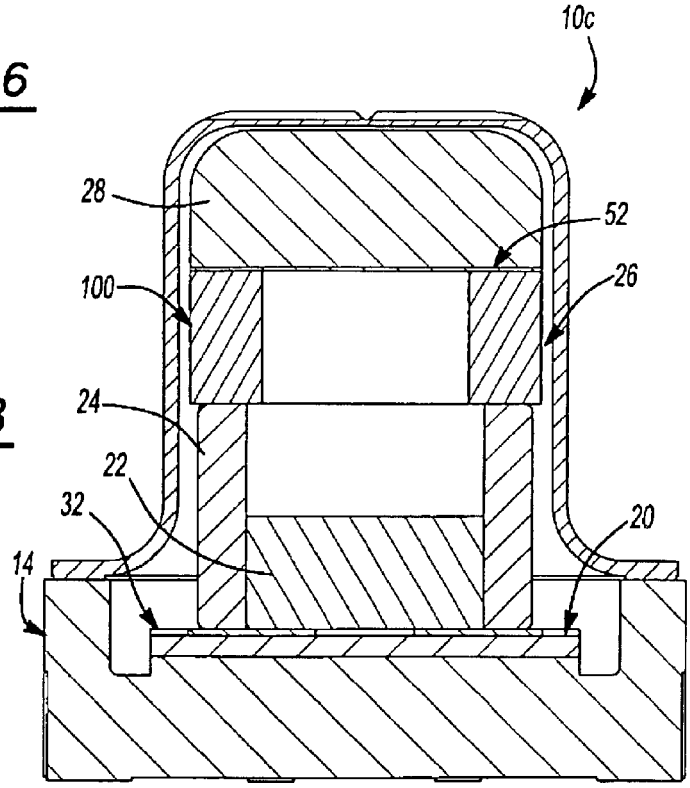
FIG. 18 is a longitudinal section view of the energetic material initiation device of FIG. 17.
Figure 17:
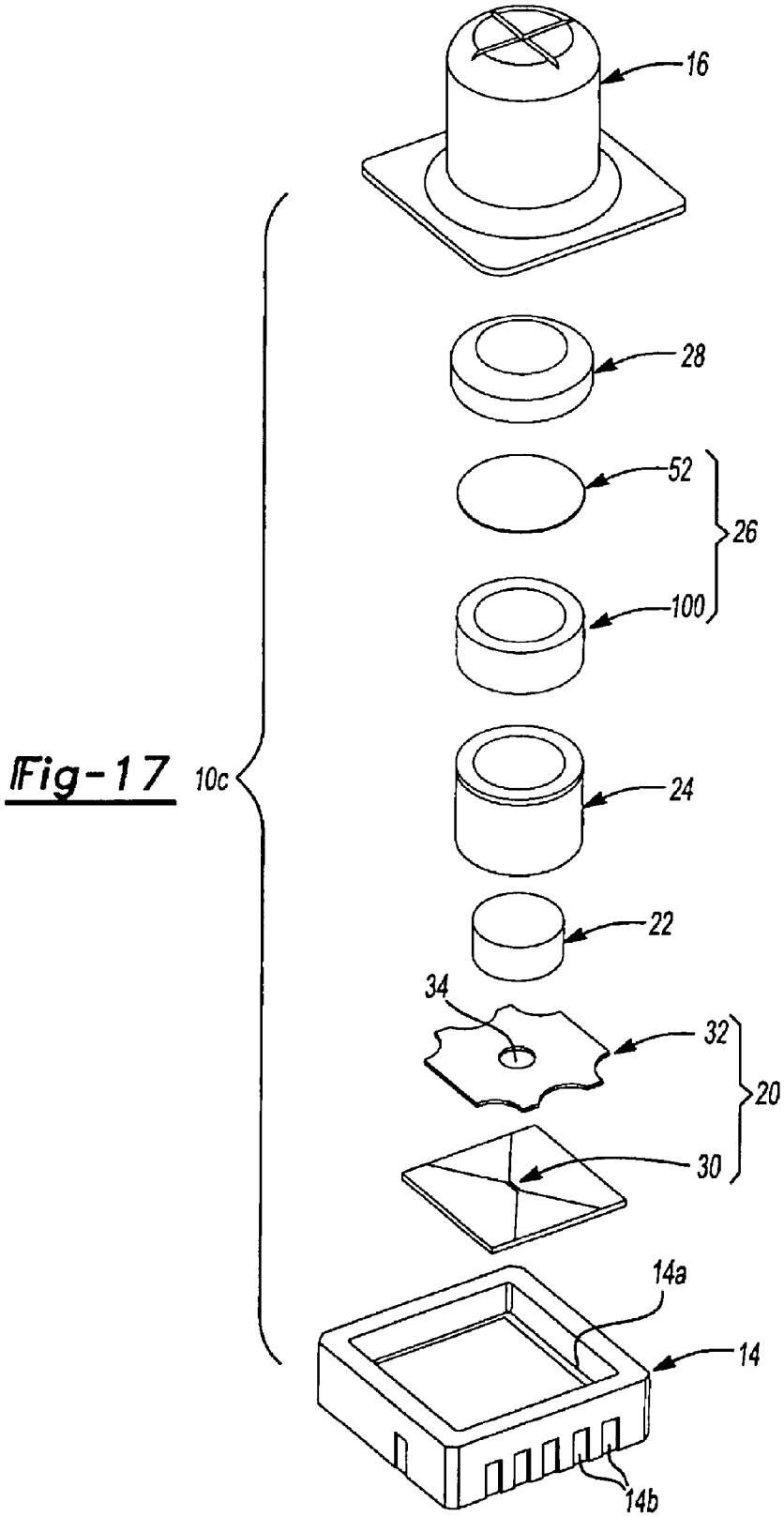
FIG. 17 is an exploded perspective view of a fourth energetic material initiation device constructed in accordance with the teachings of the present invention.
Figure 19:
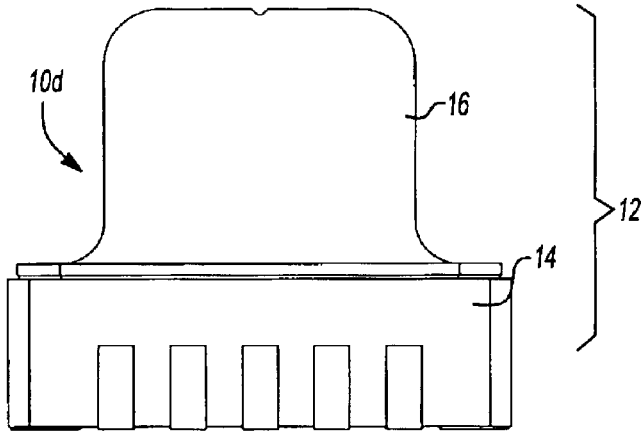
FIG. 19 is a side elevation view of a fifth energetic material initiation device constructed in accordance with the teachings of the present invention.
Figure 21:
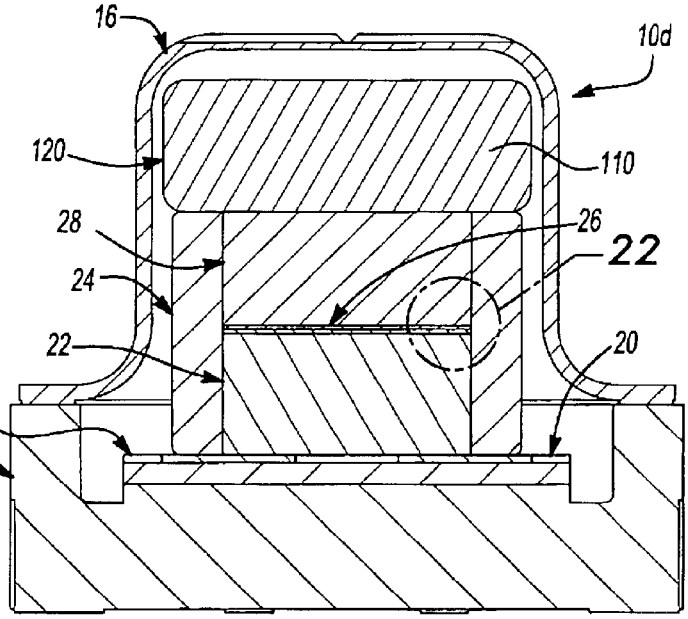
FIG. 21 is a longitudinal section view of the energetic material initiation device of FIG. 19.
Figure 22:
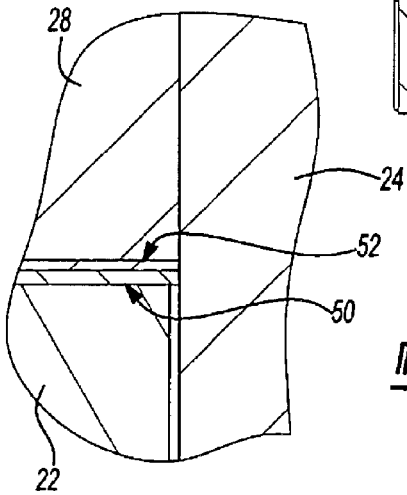
FIG. 22 is an enlarged portion of FIG. 21.
Figure 20:
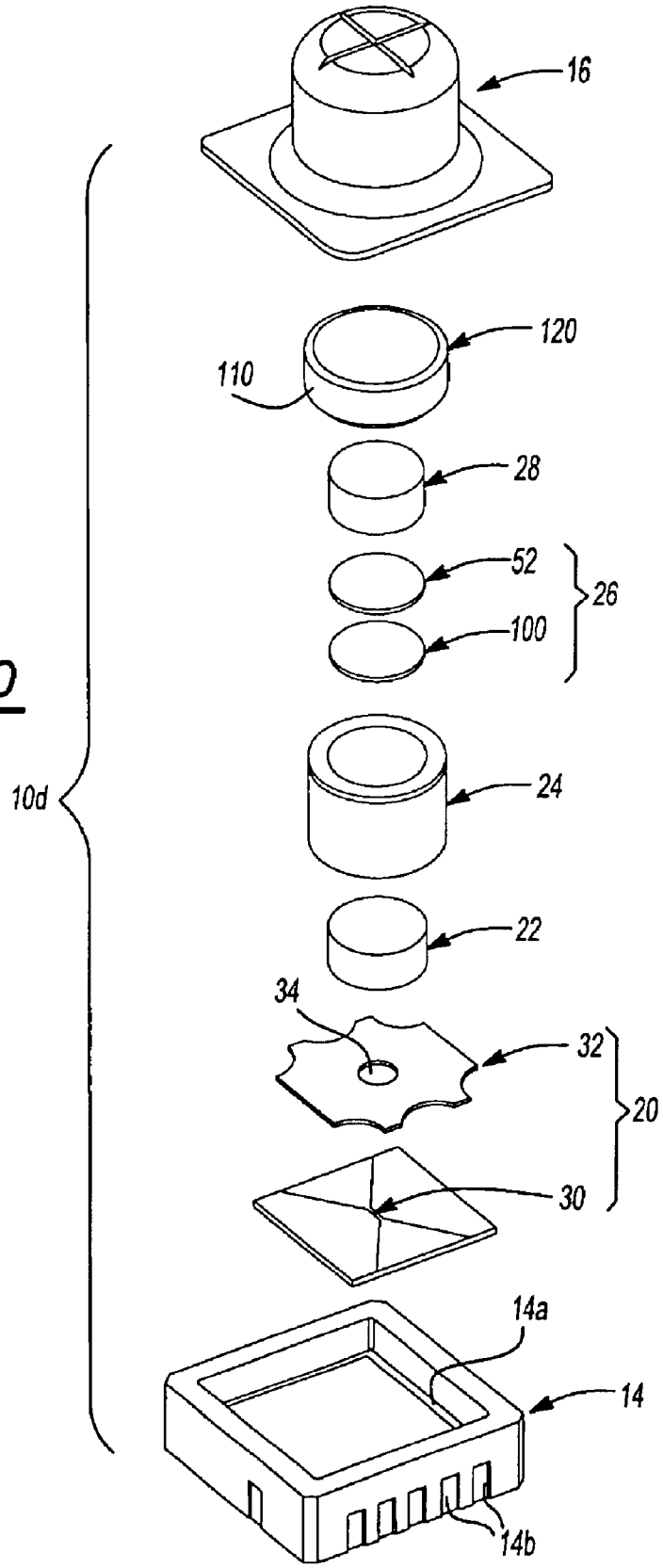
FIG. 20 is an exploded perspective view of the energetic material initiation device of FIG. 19.

In FIGS. 17 and 18, a fourth energetic material initiation device constructed in accordance with the teachings of the present invention is generally indicated by reference numeral 10*c*. The energetic material initiation device 10*c* is generally similar to the energetic material initiation device 10*a*, except that the reactable member 50 has been omitted and the positions of the oxidizer barrier member 52 and the hollow compliant member 100 are reversed relative to their positions in the energetic material initiation device 10*a* (i.e., the hollow compliant member 100 is adjacent the sleeve 24 and the oxidizer barrier member 52 is adjacent the ignition charge 28).

In FIGS. 19 through 22, a fifth energetic material initiation device constructed in accordance with the teachings of the present invention is generally indicated by reference numeral 10*d*. The energetic material initiation device 10*d* is constructed somewhat differently than the energetic material initiation device 10 of FIG. 1 in that the both the barrier structure 26 (which consists of the reactable member 50 and the oxidizer barrier member 52) and the ignition charge 28 are disposed within the sleeve 24. Additionally, a secondary barrier 120, which is illustrated to be a solid compliant member 110 in the particular embodiment provided, is disposed between the second end 46 of the sleeve 24 and the distal end of the internal side of the cover 16. The initiation charge 22, the barrier structure 26 and the ignition charge 28 are shown to take up substantially completely the entire volume of the cavity defined by the sleeve 24 such that no gap (e.g., gap 44 of FIG. 3) exists. Those skilled in the art will appreciate, however, that a gap could be formed between one or both of the charges and one or both of the barriers. This configuration is relatively more compact than the embodiment of FIG. 1, and the secondary barrier 120 provides a relatively greater degree of attenuation of the pyrotechnic output.

Figure 23:
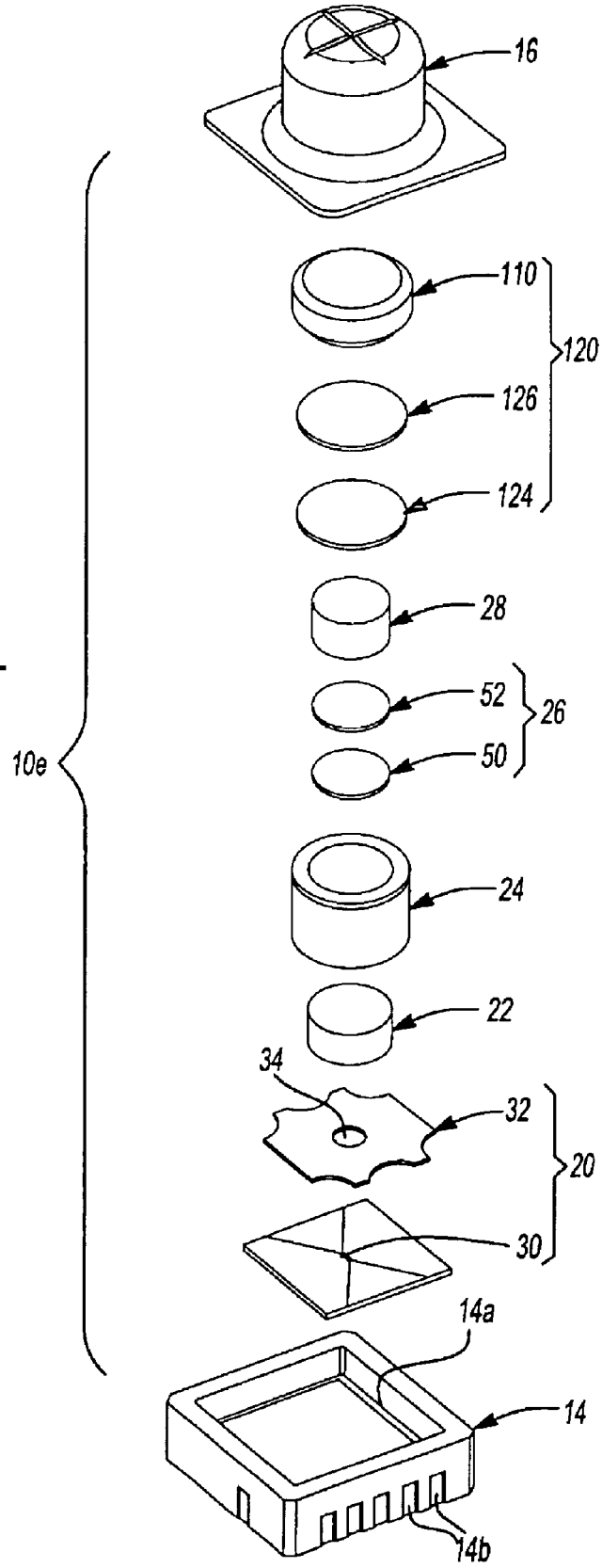
FIG. 23 is an exploded perspective view of a sixth energetic material initiation device constructed in accordance with the teachings of the present invention.
Figure 24:
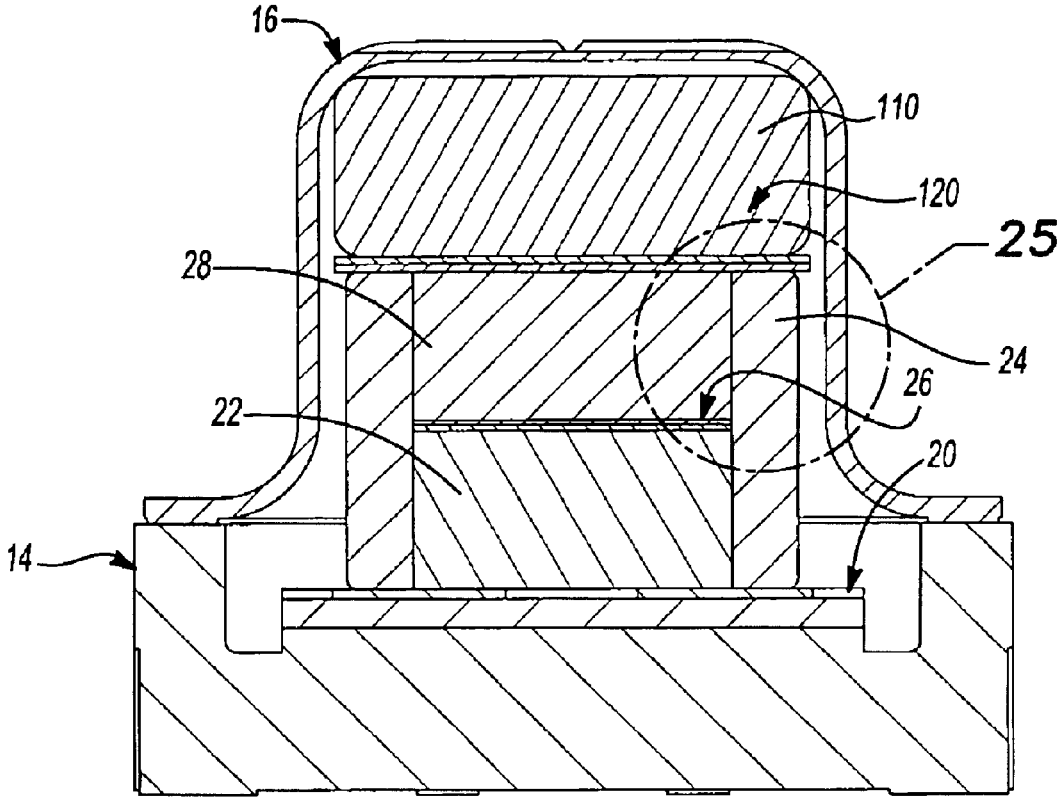
FIG. 24 is a longitudinal section view of the energetic material initiation device of FIG. 23.
Figure 25:
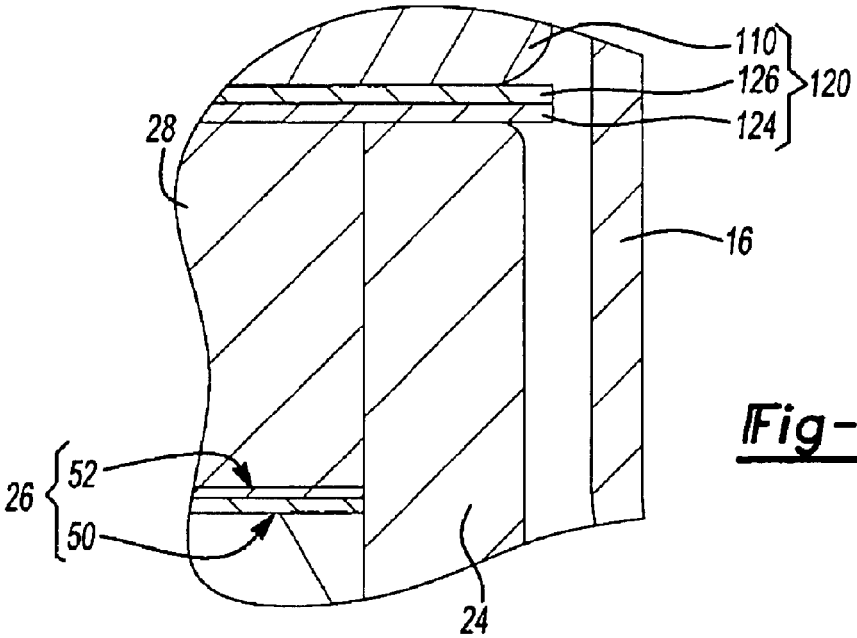
FIG. 25 is an enlarged portion of FIG. 24.
Figure 1:
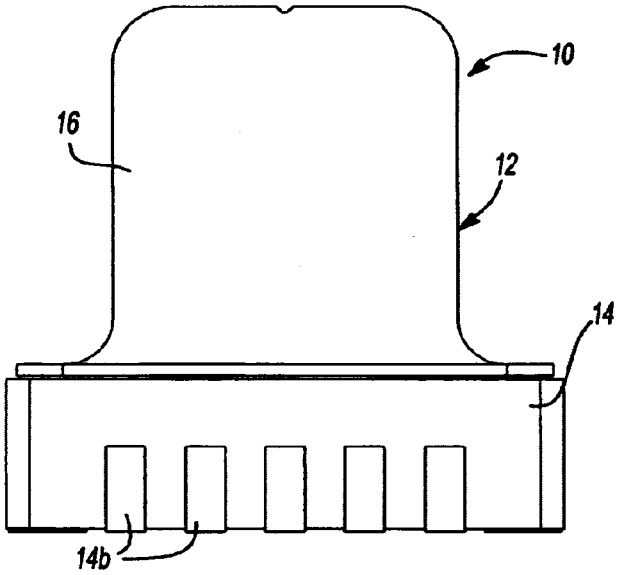
Figure 4:
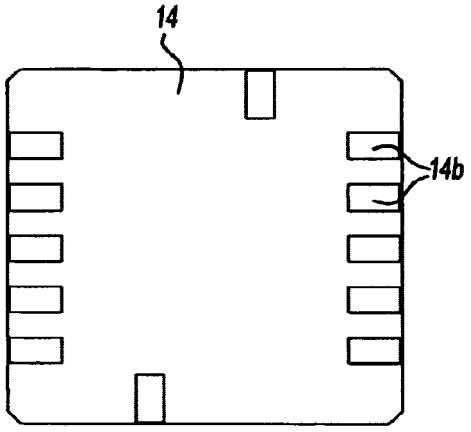
Figure 3:
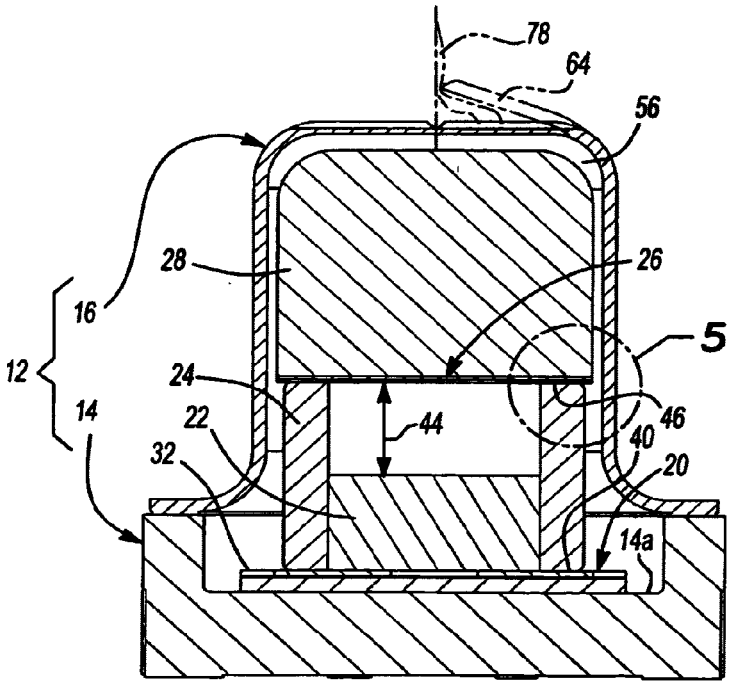
Figure 2:
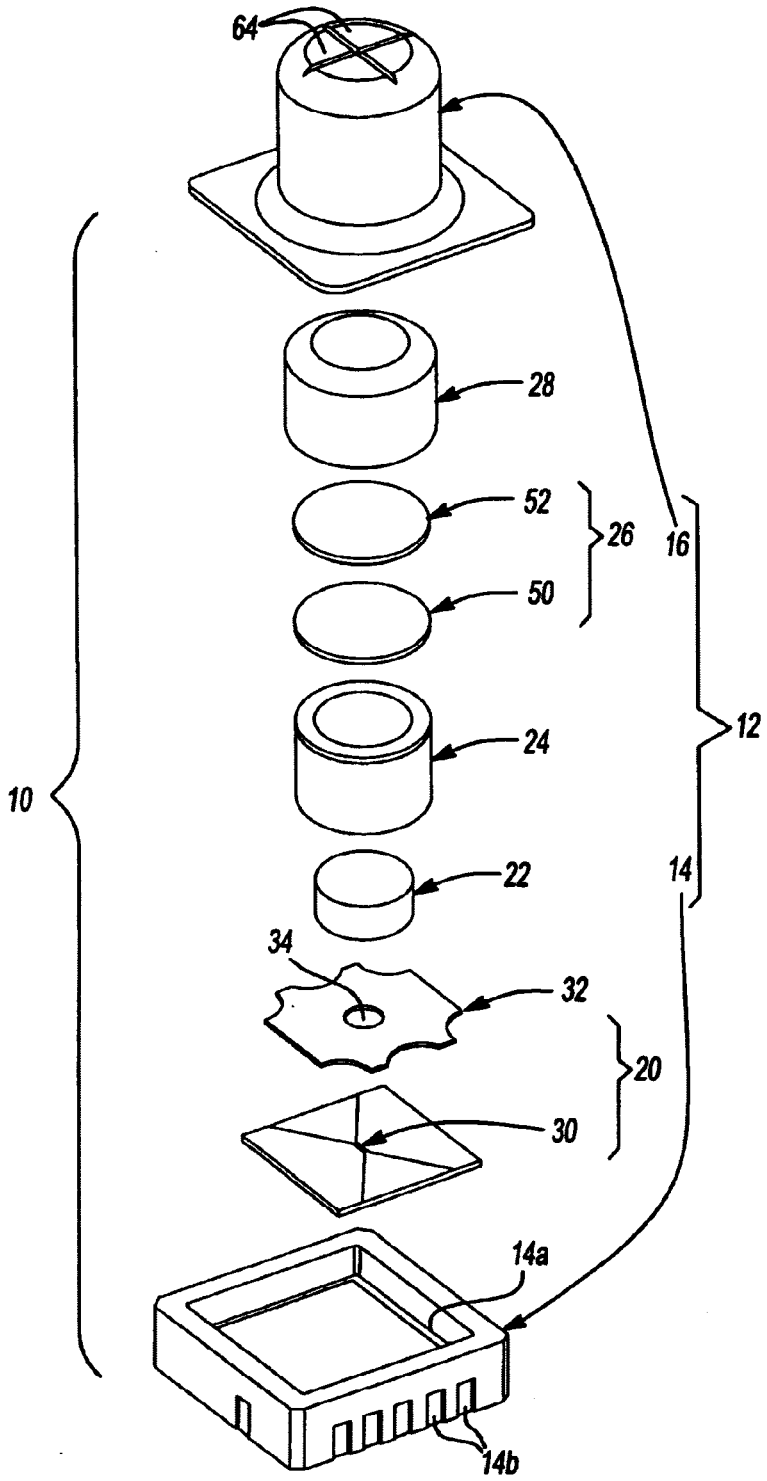

In FIGS. 23 through 25, a sixth energetic material initiation device constructed in accordance with the teachings of the present invention is generally indicated by reference numeral 10*e*. The energetic material initiation device 10*e* is generally identical to the energetic material initiation device 10*d* of FIG. 19, except that the secondary barrier 120 is illustrated to include a second reactable member 124, a second oxidizer barrier member 126 and the solid compliant member 110. The second reactable member 124 and second oxidizer barrier member 126 are similar in function and purpose to the reactable member 50 and the oxidizer barrier member 52, respectively, and as such, they will not be discussed in significant detail other than to note that the preferred materials for these elements is titanium and Teflon® (polytetrafluoroethylene), respectively.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. An energetic material initiation device, comprising:

an initiation charge;

an exploding foil initiator for selectively detonating the initiation charge;

an ignition charge; and a barrier structure disposed between the initiation charge and the ignition charge, the barrier combusting in response to energy released during detonation of the initiation charge and initiating combustion in the ignition charge;

whereby combustion of the ignition charge produces a pyrotechnic output.

2. The device of claim 1, wherein the barrier structure includes a member that is formed from a resilient material.

3. The device of claim 1, wherein the barrier structure includes a metallic member.

4. The device of claim 3, wherein the metallic member is formed of titanium.

5. The device of claim 3, wherein the barrier structure includes an oxidizer barrier that is in juxtaposed relation with a reactable member and the ignition charge.

6. The device of claim 5, wherein the oxidizer barrier is formed of polytetrafluoroethylene.

7. The device of claim 1, wherein the ignition charge consists essentially of boron potassium nitrate.

8. The device of claim 1, further comprising a sleeve having a first end and a second end opposite the first end, the initiation charge being disposed in the first end of the sleeve and abutting the exploding foil initiator.

9. The device of claim 8, wherein the second end of the sleeve abuts the barrier structure and the sleeve operatively spaces the barrier structure apart from the initiation charge so that a gap is formed therebetween.

10. The device of claim 8, wherein the barrier structure is at least partially disposed in the sleeve.

11. The device of claim 8, wherein the barrier structure includes a polytetrafluoroethylene powder that is disposed adjacent the initiation charge.

12. The device of claim 8, wherein the ignition charge is disposed in the sleeve.

13. The device of claim 12, wherein a compliant member is abutted against the second end of the sleeve such that the ignition charge is in juxtaposed relation with the barrier structure and the compliant member.

14. The device of claim 12, further comprising a secondary barrier structure, the secondary barrier structure being disposed on a side of the ignition charge opposite the barrier structure.

15. The device of claim 14, wherein the secondary barrier structure includes a reactable member.

16. The device of claim 14, wherein the secondary barrier structure includes an oxidizer barrier.

17. The device of claim 16, wherein the oxidizer barrier is formed of polytetrafluoroethylene.

18. The device of claim 1, further comprising a housing into which the initiation charge, the exploding foil initiator, the ignition charge and the barrier structure are disposed.

19. The device of claim 18, wherein the housing includes a cover that ruptures in at least one area in response to the heat and pressure generated during combustion of the ignition charge.

20. The device of claim 19, wherein a stress riser is formed in the cover which causes the cover to rupture in a predetermined area.

21. The device of claim 20, wherein the stress riser is formed from at least one of a groove and a perforation.

22. The device of claim 18, wherein the housing further includes a base, the base having a ceramic, leadless chip carrier to which the exploding foil initiator is coupled, the base being sealingly coupled to the cover.

23. A energetic material initiation device, comprising:

a base;

an initiation charge;

an exploding foil initiator coupled to the base and operable for selectively producing a shockwave to initiate detonation of the initiation charge;

a hollow sleeve housing the initiation charge;

an ignition charge;

a barrier structure disposed between the initiation charge and the ignition charge; and a cover coupled to the base, the cover cooperating with base to house the exploding foil initiator, the initiation charge, the hollow sleeve, the ignition charge and the barrier structure;

wherein combustion in the ignition charge is initiated by a chemical reaction in which energy released during detonation of the initiation charge and an ensuing reaction with at least a portion of the barrier structure; and wherein the cover ruptures in response to the initiation of combustion in the ignition charge to thereby provide a pyrotechnic output.

24. The device of claim 23, wherein the cover and the base are sealingly coupled to one another.

25. The device of claim 23, wherein the barrier structure includes a member that is formed from a resilient material.

26. The device of claim 23, wherein the barrier structure includes a reactable member.

27. The device of claim 23, wherein the barrier structure is at least partially formed of titanium.

28. The device of claim 27, wherein the portion of the barrier structure that reacts includes a reactable member and the barrier structure further includes an oxidizer barrier that is in juxtaposed relation with the reactable member and the ignition charge.

29. The device of claim 28, wherein the oxidizer barrier is formed of polytetrafluoroethylene.

30. The device of claim 23, wherein the ignition charge consists essentially of boron potassium nitrate.

31. The device of claim 23, further comprising a sleeve having a first end and a second end opposite the first end, the initiation charge being disposed in the first end of the sleeve and abutting the exploding foil initiator.

32. The device of claim 31, wherein the second end of the sleeve abuts the barrier structure and the sleeve operatively spaces the barrier structure apart from the initiation charge so that a gap is formed therebetween.

33. The device of claim 31, wherein the barrier structure is at least partially disposed in the sleeve.

34. The device of claim 31, wherein the barrier structure includes a polytetrafluoroethylene powder that is disposed adjacent the initiation charge.

35. The device of claim 33, wherein the ignition charge is disposed in the sleeve.

36. The device of claim 35, wherein a compliant member is abutted against the second end of the sleeve such that the ignition charge is in juxtaposed relation with the barrier structure and the compliant member.

37. The device of claim 35, further comprising a secondary barrier structure, the secondary barrier structure being disposed on a side of the ignition charge opposite the barrier structure.

38. The device of claim 37, wherein the secondary barrier structure includes a reactable member.

39. The device of claim 37, wherein the secondary barrier structure includes an oxidizer barrier.

40. The device of claim 39, wherein the oxidizer barrier is formed of polytetrafluoroethylene.

41. The device of claim 23, wherein a stress riser is formed in the cover which causes the cover to rupture in a predetermined area.

42. The device of claim 41, wherein the stress riser includes a plurality of intersecting features, the features being selected from a group consisting of grooves and perforations.

43. The device of claim 23, wherein the base is a ceramic, leadless chip carrier.

44. An energetic material initiation device, comprising:

a base including a ceramic, leadless chip carrier;

an initiation charge;

an exploding foil initiator coupled to the base and operable for selectively producing a shockwave to initiate detonation of the initiation charge;

a hollow sleeve housing the initiation charge;

an ignition charge;

a barrier structure disposed between the initiation charge and the ignition charge, the barrier structure including a reactable member and an oxidizer barrier; and a cover coupled to the base, the cover cooperating with base to house the exploding foil initiator, the initiation charge, the hollow sleeve, the ignition charge and the barrier structure, the cover being formed with at least one stress riser, the at least one stress riser including a plurality of intersecting features, the features being selected from a group consisting of grooves and perforations;

wherein the initiation charge, the barrier structure and the initiation charge cooperate to convert the shockwave into a pyrotechnic output that ruptures the cover in an area determined by the at least one stress riser.

* * * * *

UNITED STATES PATENT AND TRADEMARK OFFICE

CERTIFICATE OF CORRECTION

PATENT NO. : 6,923,122 B2
DATED : August 2, 2005
INVENTOR(S) : George N. Hennings et al.

It is certified that error appears in the above-identified patent and that said Letters Patent is hereby corrected as shown below:

The title page should be deleted to appear as per attached title page.

The sheet of drawing consisting of figure 2 should be deleted to appear as per attached figure 2.
Sheet 1 of the drawings should be deleted to appear as per attached Sheet 1.

Signed and Sealed this

Twentieth Day of December, 2005

JON W. DUDAS
*Director of the United States Patent and Trademark Office*

(12) United States Patent
Hennings et al.

(10) Patent No.: US 6,923,122 B2
(45) Date of Patent: Aug. 2, 2005

(54) ENERGETIC MATERIAL INITIATION DEVICE UTILIZING EXPLODING FOIL INITIATED IGNITION SYSTEM WITH SECONDARY EXPLOSIVE MATERIAL

(75) Inventors: George N. Hennings, Ridgecrest, CA (US); Dieter K. Teschke, Vacaville, CA (US); Richard K. Reynolds, Calistoga, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 10/316,126

(22) Filed: Dec. 10, 2002

(65) Prior Publication Data

US 2004/0107856 A1 Jun. 10, 2004

(51) Int. Cl.[7] ..... F42C 11/00
(52) U.S. Cl. ..... 102/202.7; 102/204
(58) Field of Search ..... 102/202.7, 202.6, 102/202.5, 204, 530, 202.2; 280/737; F42C 19/04, 11/00; F42B 3/00

(56) References Cited

U.S. PATENT DOCUMENTS 1,313,801 A * 8/1919 Doran ..... 102/204
4,144,814 A * 3/1979 Day et al. ..... 102/202.13
4,541,342 A * 9/1985 Routledge ..... 102/308
4,735,145 A * 4/1988 Johnson et al. ..... 102/202.5
5,030,301 A * 7/1991 Stout et al. ..... 149/5
5,113,764 A * 5/1992 Mandigo et al. ..... 102/202.9
5,411,290 A * 5/1995 Chan et al. ..... 280/737
5,721,392 A * 2/1998 Chan et al. ..... 102/275.1
6,568,331 B2 * 5/2003 Hofmann et al. ..... 102/464
2003/0200890 A1 * 10/2003 Reynolds et al. ..... 102/202.5

OTHER PUBLICATIONS

U.S. Appl. No.: 10/137,063, Filed: Apr. 30, 2002, Inventor: Thomas M. Nickolin et al.

* cited by examiner

*Primary Examiner*—Michael J. Carone
*Assistant Examiner*—Susan C. Alimenti
(74) *Attorney, Agent, or Firm*—Harness, Dickey & Pierce, P.L.C.

(57) ABSTRACT

A device and method that employs a detonation event as an energy source for producing a pyrotechnic output. The device includes an initiation charge that is selectively detonated by an exploding foil initiator. Byproducts from the detonation event are attenuated by a barrier that is disposed between the initiation charge and an ignition charge. The barrier participates in a chemical reaction with the detonation byproducts to oxidize and burn. In this regard, the barrier serves as a fuel that is employed to ignite the ignition charge. The device includes a sealed housing in which the initiator, initiation charge and ignition charges are housed. The housing ruptures in response to the heat and pressure generated by the ignited ignition charge to release the pyrotechnic output.

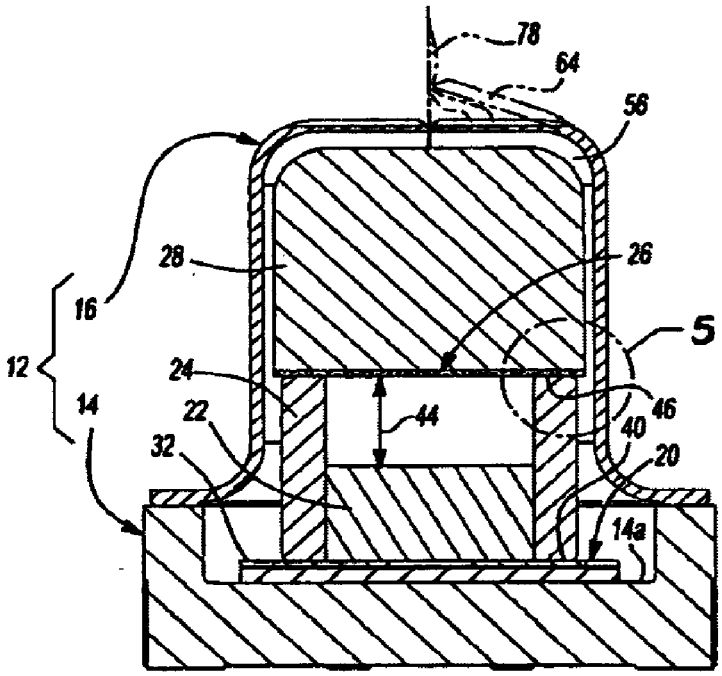

44 Claims, 13 Drawing Sheets